US007036485B1

(12) United States Patent
Koerner

(10) Patent No.: US 7,036,485 B1
(45) Date of Patent: May 2, 2006

(54) METHOD AND SYSTEM OF THROTTLE CONTROL CALIBRATION

(75) Inventor: Scott A. Koerner, Kenosha, WI (US)

(73) Assignee: BRP US Inc., Sturtevant, WI (US)

( * ) Notice: Subject to any disclaimer, the term of this patent is extended or adjusted under 35 U.S.C. 154(b) by 0 days.

(21) Appl. No.: 10/708,083

(22) Filed: Feb. 6, 2004

(51) Int. Cl.
*F02D 1/00* (2006.01)

(52) U.S. Cl. ..... 123/396; 123/399

(58) Field of Classification Search ..... 123/396, 123/399
See application file for complete search history.

(56) References Cited

U.S. PATENT DOCUMENTS 4,539,963 A 9/1985 Brisbane et al.
4,961,342 A 10/1990 Matsumoto et al.
5,571,960 A 11/1996 Tateishi et al.
5,698,778 A 12/1997 Ban et al.
5,906,524 A 5/1999 Ozawa et al.
5,967,861 A 10/1999 Ozawa et al.
6,029,510 A 2/2000 Nakaie et al.
6,220,904 B1 4/2001 Hoshiba et al.
6,321,592 B1 * 11/2001 Bylsma et al. ..... 73/117.3
6,351,704 B1 * 2/2002 Koerner ..... 701/115
6,371,819 B1 4/2002 Ozawa et al.
6,484,693 B1 * 11/2002 Kanno ..... 123/339.15
6,573,614 B1 * 6/2003 Doll ..... 290/40 C
6,640,621 B1 11/2003 Ward et al.
6,704,643 B1 * 3/2004 Suhre et al. ..... 701/115
6,845,649 B1 * 1/2005 Kubota et al. ..... 73/1.75
2002/0166362 A1 * 11/2002 Kubota et al. ..... 73/1.75
2003/0052486 A1 * 3/2003 Doll ..... 290/40 C

* cited by examiner

*Primary Examiner*—John T. Kwon
(74) *Attorney, Agent, or Firm*—Osler, Hoskin Harcourt LLP

(57) ABSTRACT

A method and system of throttle calibration control is presented that includes a TPS designed to provide an output indicative of throttle plate position when the throttle plate is opened and provide an output of throttle actuator position when the throttle plate is closed. The TPS output is received by an ECU to control subsequent engine operation. When an input is received from the TPS indicating that the throttle actuator is within a pre-set idle throttle position range and below an idle position benchmark, the ECU automatically reestablishes present and subsequent engine operation.

26 Claims, 9 Drawing Sheets

METHOD AND SYSTEM OF THROTTLE CONTROL CALIBRATION

BACKGROUND OF INVENTION

The present invention relates generally to electronically controlled internal combustion engines and, more particularly, to a method and system of throttle control calibration.

Increasingly, internal combustion engines are equipped with electronic control units (ECU) that dynamically control engine and engine component operation based on sensory feedback received from the engine and its components. From the feedback, the ECU, which typically includes one or more microprocessors and electronic maps, is able to assess such parameters as throttle position and air intake to control fuel injection and ignition systems, among other engine systems, to optimize engine performance. In this regard, the ECU is able to control the engine to operate with improved fuel efficiency and reduced emissions.

ECU control of the engine and its components is commonly governed, to an extent, on feedback received from a throttle position sensor (TPS). A TPS is commonly used to provide feedback to the ECU as to the relative position of a throttle actuator or lever between an idle position and a wide open throttle (WOT) position. As is well-known, the throttle actuator is linked by a throttle linkage to a throttle plate which is caused to rotate relative to an air intake opening by a throttle shaft positioned in a throttle body so as to control air intake to the engine. Typically, the throttle plate is caused to rotate in response to operator-initiated commands that are received across the throttle linkage. The throttle linkage customarily connects the throttle shaft to the throttle actuator, e.g. foot pedal or hand controlled device. In marine applications, the throttle actuator may typically be found as a hand controlled device at the bridge or control station of a watercraft.

Ideally, a single throttle linkage would be used to connect the throttle shaft (and ultimately the throttle plate) to the throttle actuator. With a single piece throttle linkage, a more accurate or precise measurement of throttle actuator and throttle plate position is obtainable. That is, with a throttle linkage that includes multiple throttle pieces or components, the TPS may not output an accurate throttle actuator position as a result of variances, play, or slop in the linkage. This can be particularly problematic for marine applications such as outboard motors.

It is not uncommon for outboard motors to be sold independent of a watercraft. That is, a consumer may already own or has selected to purchase a watercraft and desires to replace an existing motor or have a motor added, respectively. As such, watercraft are typically constructed to have a throttle actuator linkage that is to be connected to a separate throttle linkage of the outboard motor when the motor is mounted to the watercraft. Therefore, multiple linkages or components are used to connect the throttle assembly of the motor to the throttle actuator assembly of the watercraft. These multiple linkages create response variances that can negatively affect the precision of a TPS output.

For example, when an operator "pulls back" on the throttle actuator in an open throttle position, the combined throttle linkages will cause the throttle shaft to rotate the throttle plate to a more closed position. As the throttle is moved to a more closed position, air intake is reduced. Feedback regarding this more-toward-closed action is received by the ECU from the TPS whereupon the ECU may command the fuel injection and ignition systems to adjust their operation in light of the reduced air intake and lower desired speed. When a watercraft operator pulls completely back on the throttle actuator, or indicates by other means, a desire to bring the engine to idle, the throttle linkage ideally induces movement of the throttle shaft to rotate the throttle plate to a fully closed position. Idle is typically defined as the engine's slowest practical operating speed. Driving the engine to idle typically results in a rotation of the throttle plate to a closed position. Typically, either the throttle plate is left open a small amount at idle for air entry, or holes are provided in the throttle plate to provide a passage of air to the engine when the throttle plate is closed. That is, there in a range of engine operation that may be defined between engine idle and engine operation when the throttle plate is closed.

As a result of the variances in the throttle linkage connecting the throttle plate to the throttle actuator, the throttle actuator may reach an idle indicative position, but the throttle linkage may not. Accordingly, the ECU will adjust subsequent engine operations on a perceived but not actual idle throttle position. Specifically, idle throttle positioning is deemed to occur when the throttle actuator is within a range of throttle actuator positions independent of actual throttle plate or throttle shaft position. Moreover, the ECU will also adjust subsequent engine operation when a WOT position is detected within a pre-set range. Just as the variances in the throttle linkages affect the determination of idle, the variances also affect the determination of WOT.

At WOT, some ECUs may ignore the oxygen sensor signal in the engine's exhaust system and drive the fuel injection system to provide a rich fuel mixture for combustion. Accordingly, it is paramount that the ECU accurately determine, based on TPS output, when the throttle actuator is at idle or at WOT. The TPS is typically a potentiometer that includes a rotating lever or wiper arm that moves across a resistive element and outputs a different voltage value in response. For example, at WOT, the TPS may output a five volt signal. At idle, the TPS may output a 0.5 volt signal. The wiper arm, which rotates as a function of the throttle linkage, is typically constructed to have a rotating range that exceeds the rotating range of the throttle plate. In this regard, the wiper arm may continue to rotate to a more WOT position, but the throttle plate will not open any further and the TPS will not provide a different output signal than that achieved at WOT. The same, however, is not true at idle.

While a fully open throttle plate is indicative of WOT, a closed throttle plate is not indicative of idle engine running. As mentioned above, throttle plates may include one or more holes that allow the passage air to the engine when the plate is closed. Accordingly, the wiper arm will continue to rotate even though the throttle plate has closed. This additional rotation is necessary to indicate to the ECU that the throttle actuator has been driven to a position beyond that defined by throttle plate closing. As such, when the TPS provides an output of 0.5 volts, the throttle actuator is deemed to be at a position corresponding to engine idle. However, as noted above, as a result of variances in the throttle linkage, the TPS may not be able to provide 0.5 volt output even though the throttle actuator is at a position corresponding to engine idle. Conversely, the TPS may not be able to provide a 5.0 volt output even though the throttle actuator is at a position corresponding to WOT or provide a 5.0 volt output even though the throttle plate has not reached a WOT position. As a result, the ECU may not optimize subsequent engine operation.

One solution that has been developed is to define a range of positions in which the throttle actuator may be positioned to be indicative of desired engine idle. In this regard, if the TPS provides an output within a certain range, the ECU will deem the throttle actuator to be at a corresponding idle position and control subsequent engine operation accordingly. This solution similarly provides a range of acceptable WOT values such that if the TPS provides an output within this range, the ECU will control the engine and its components to run according to WOT.

One drawback of this solution is its complexity. Another is the manner in which it is applied. Regarding the former, idle and WOT ranges must be defined and separately monitored which greatly adds to the micro-processing power needed of the ECU as well as its memory requirements. Regarding the latter, this solution redefines a TPS idle and a TPS WOT output only at each engine startup. That is, a maximum and a minimum value for output of the TPS is determined at engine startup and is stored, provided the values fall within a pre-defined range. For the remainder of the engine operating session, these values will be used to define when the throttle actuator has reached a position corresponding to engine-at-idle or engine-at-WOT. Since a percentage opening of the throttle plate will govern engine operation, actual throttle actuator position relative to the minimum (idle) and maximum (WOT) values will be controlling. While this may be appropriate for throttle actuator positions between idle and WOT, variances in the throttle linkages may prevent the TPS from outputting the minimum or maximum value or falsely provide a minimum or maximum output. Accordingly, the ECU will not deem the throttle actuator to be at a position corresponding to engine idle or WOT despite the appropriate positioning of the throttle actuator by the watercraft operator. Moreover, since the TPS measures a relative position of the throttle actuator rather than the actual throttle plate or throttle shaft position, the TPS may provide a false indication of WOT or idle position.

It would therefore be desirable to have a simplified system and method of calibrating an ECU for subsequent engine operation that accounts for variances in throttle linkages for optimized engine operation. It would also be desirable to have a TPS that provides an accurate measure of throttle plate as well as throttle actuator position for calibration of the ECU. It would be further desirable to have a system that recalibrates the ECU for subsequent engine operation when the throttle actuator is positioned at a position corresponding to idle independent of engine operating mode.

BRIEF DESCRIPTION OF INVENTION

The present invention provides a system and method of throttle control calibration that overcomes the aforementioned drawbacks.

The invention includes a TPS that is designed to provide an output indicative of throttle plate position when the throttle plate is opened and provide an output of throttle actuator position when the throttle plate is closed. The TPS output is received by an ECU to control subsequent engine operation. When an input is received from the TPS indicating that the throttle actuator is within a pre-set idle throttle position range, the ECU will automatically reestablish or reconfigure present and subsequent engine operation. Since the TPS is designed to output a signal indicative of throttle plate position when the throttle plate is open, the ECU receives relatively precise input as to the exact position of the throttle plate with respect to WOT independent of throttle actuator position. In this regard, a dual-mode TPS is also presented.

Therefore, in accordance with one aspect of the present invention, a throttle calibration control is provided and configured to determine if throttle actuator position is within an idle position range and, if so, maintain the throttle actuator position as an idle position benchmark for subsequent engine operation until a subsequent throttle actuator positioning below the idle position benchmark. The control is further configured to establish a WOT position benchmark for subsequent engine operation based on a fixed angular position from the idle position benchmark.

In accordance with another aspect, the present invention includes a control system for an internal combustion engine. The system includes a TPS configured to provide an output indicative of actual throttle position and an ECU to control operation of an internal combustion engine. The ECU is configured to set a new engine operation paradigm for subsequent engine operation with each placement of a variable position throttle below a previous idle position benchmark.

According to another aspect of the present invention, an outboard motor includes an internal combustion engine configured to propel a watercraft and a throttle linkage connectable to a throttle and configured to control movement of a throttle shaft and throttle plate based on input received from the throttle. The motor also includes a TPS connected to sense rotational position of the throttle shaft and translation of the throttle linkage, and is also configured to provide a first output indicative of throttle plate position relative to WOT during an open throttle plate condition and provide a second output indicative of throttle position during a closed throttle plate operation. The motor further includes an ECU configured to receive an input indicative of throttle position during closed throttle plate operation and re-establish subsequent engine operation with positioning of the throttle in a predefined idle throttle position range.

In accordance with yet a further aspect, the present invention includes a method of throttle control calibration that includes the step determining if throttle actuator position is within an idle position range. The method also includes maintaining the throttle actuator position as an idle position benchmark for subsequent engine operation until a subsequent throttle actuator positioning in the idle position range and more toward idle than a previous idle position benchmark. A WOT position benchmark for subsequent engine operation is also established based on a fixed angular position from the idle position benchmark.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

The present invention relates generally to internal combustion engines. In the present embodiment, the engine is a direct fuel injected, spark-ignited two-cycle gasoline-type engine. While many believe that two-stroke engines are generally not environmentally friendly engines, such preconceptions are misguided in light of contemporary two-stroke engines. Modern direct injected two-stroke engines and, in particular, EVINRUDE outboard motors, are compliant with, not only today's emission standards, but emissions standards well into the future. EVINRUDE is a registered trademark of the assignee of this application. However, since these engines are so advanced, they require trained technicians perform certain repairs and adjustments. As such, a significant portion of the ability to manipulate the operation of these motors has been restricted to qualified personnel in an effort to ensure the future emission efficiency of the engines. Further, the illustrated outboard motor has fuel injectors that are extremely fast and responsive. These injectors are not only state-of-the-art in terms of performance, they are so highly tuned that engines so equipped greatly exceed environmental emissions standards for years to come. To obtain such exacting performance, the injectors operate at a rather high voltage, preferably 55 volts.

Figure 1:
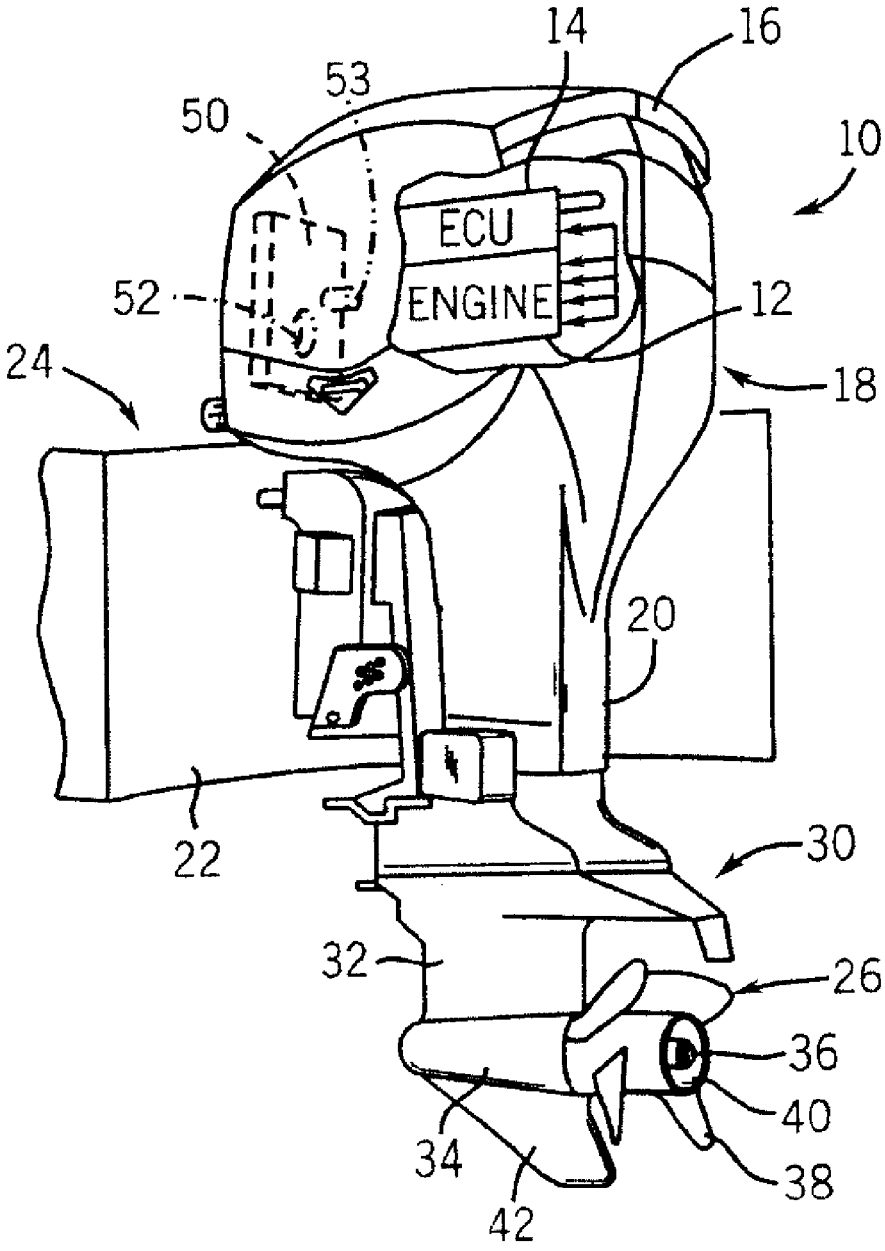
FIG. 1 is a perspective view of an exemplary outboard motor incorporating the present invention.

FIG. 1 shows an outboard motor 10 having one such engine 12 controlled by an electronic control unit (ECU) 14 under engine cover 16. Engine 12 is housed generally in a powerhead 18 and is supported on a mid-section 20 configured for mounting on a transom 22 of a boat 24 in a known conventional manner. Engine 12 is coupled to transmit power to a propeller 26 to develop thrust and propel boat 24 in a desired direction. A lower unit 30 includes a gear case 32 having a bullet or torpedo section 34 formed therein and housing a propeller shaft 36 that extends rearwardly therefrom. Propeller 26 is driven by propeller shaft 36 and includes a number of fins 38 extending outwardly from a central hub 40 through which exhaust gas from engine 12 is discharged via mid-section 20. A skeg 42 depends vertically downwardly from torpedo section 34 to protect propeller fins 38 and encourage the efficient flow of outboard motor 10 through water.

A throttle body 50 (shown in phantom), is connected to engine 12 and has at least one opening 52 passing therethrough. The number of openings generally corresponds to a number of cylinders in engine 12. Only one is shown for a two-cylinder engine for exemplary reasons. Opening 52 is often referred to as an air intake opening and allows combustion gas, generally air, to pass through throttle body 50 and into engine 12. Another opening 53, an idle air bypass, passes through throttle body 50 and provides an alternate path for combustion gas into and through throttle body 50. As will be described further below, opening 53 is constructed to provide combustion gas to engine 12 during idle and low speed operations.

Figure 2:
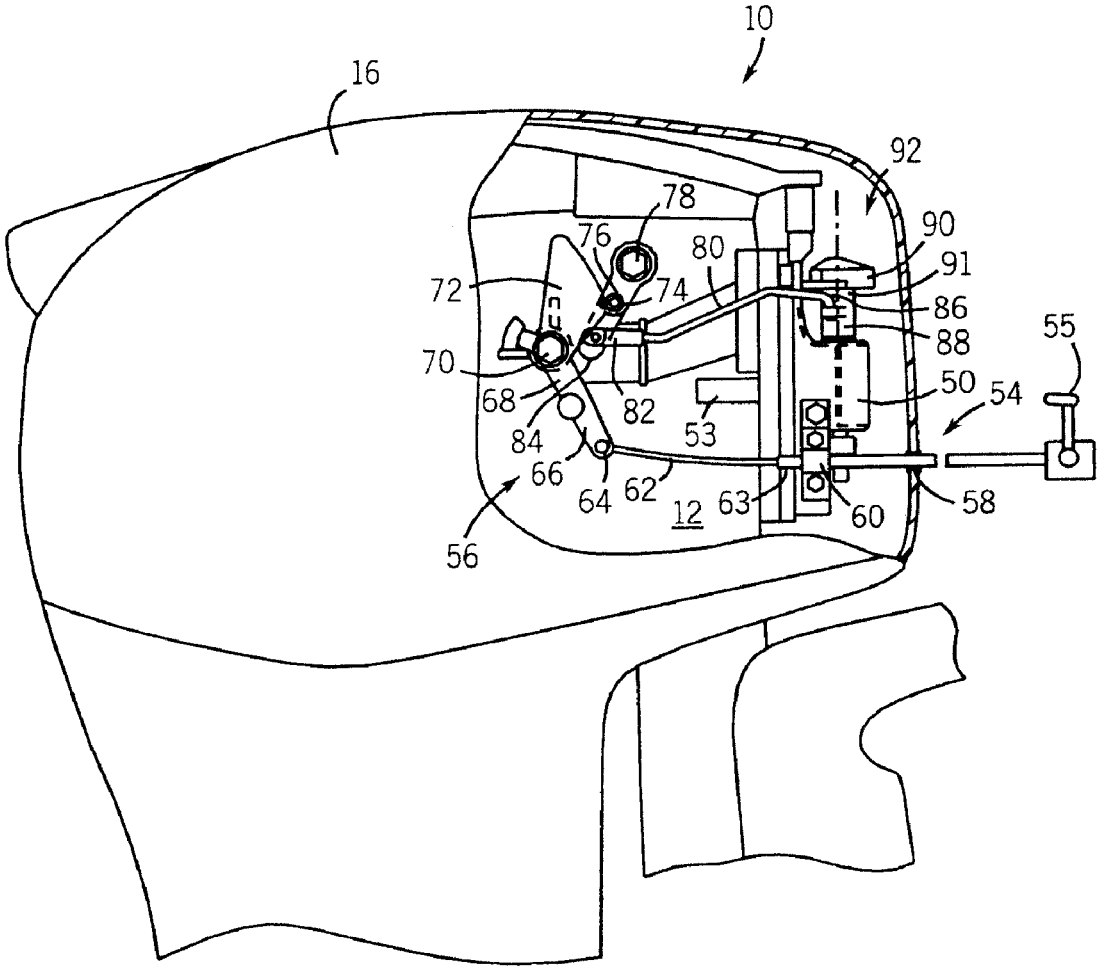
FIG. 2 is an elevational view of a portion of the outboard motor of FIG. 1 showing the throttle linkage and throttle assembly of the present invention.

FIG. 2 shows outboard motor 10 with a portion of engine cover 16 cut away. A throttle cable 54 connects a throttle actuator 55 to a throttle linkage assembly 56 so that throttle linkage assembly 56 is movable in response to operator manipulation of throttle actuator 55. Throttle cable 54 passes through an opening 58 formed in engine cover 16. A mounting bracket 60 secures throttle cable 54 to throttle body 50 and prevents movement therebetween. Throttle cable 54 has a cable 62 which extends from an end 63 thereof. Cable 62 extends and retracts from throttle cable 54 relative to mounting bracket 60 in response to operator manipulation of throttle actuator 55. An end 64 of cable 62 engages a first throttle link 66 of throttle linkage assembly 56. Cable end 64 is attached to a first arm 68 of first throttle link 66 so that movement of cable 62 results in rotation of first throttle link 66 about a pin or mounting bolt 70.

A second arm 72 of first throttle link 66 engages a pin 74 extending from a second throttle link 76 of throttle linkage assembly 56. Second throttle link 76 rotates about a pin 78 and has a third throttle link 80 attached thereto. A first end 82 of third throttle link 80 is connected to an end 84 of second throttle link 76. A second end 86 of third throttle link 80 is attached to an actuator 88 of a throttle assembly 92. During operation, as an operator advances throttle actuator 55, throttle cable 62 moves and rotates first throttle link 66 of throttle link assembly 56 about pin 70. Rotation of first throttle link 66 causes second arm 72 to engage pin 78 and thereby rotate second throttle link 76. Displacement of second throttle link 76 is translated to throttle assembly 92 via third throttle link 80 so that actuator 88 is coupled to throttle actuator 55. Such a linkage forms a throttle assembly that is highly responsive and sensitive to operator manipulation of a throttle actuator.

Referring to throttle assembly 92, a mount, having a throttle position sensor (TPS) 91 inside, is connected proximate a first end 91 of actuator 88. The TPS 91 communicates the position of actuator 88 to the ECU of engine 12. In addition to the responsiveness of the throttle assembly, mounting TPS 91 about the actuator of the throttle assembly ensures that an ECU attached thereto is nearly instantaneously aware of operator manipulation of throttle actuator 55. Such a construction connects a throttle linkage assembly and throttle assembly with reduced play therebetween and allows an engine 12 so equipped to be highly responsive to actual throttle position.

Figure 3:
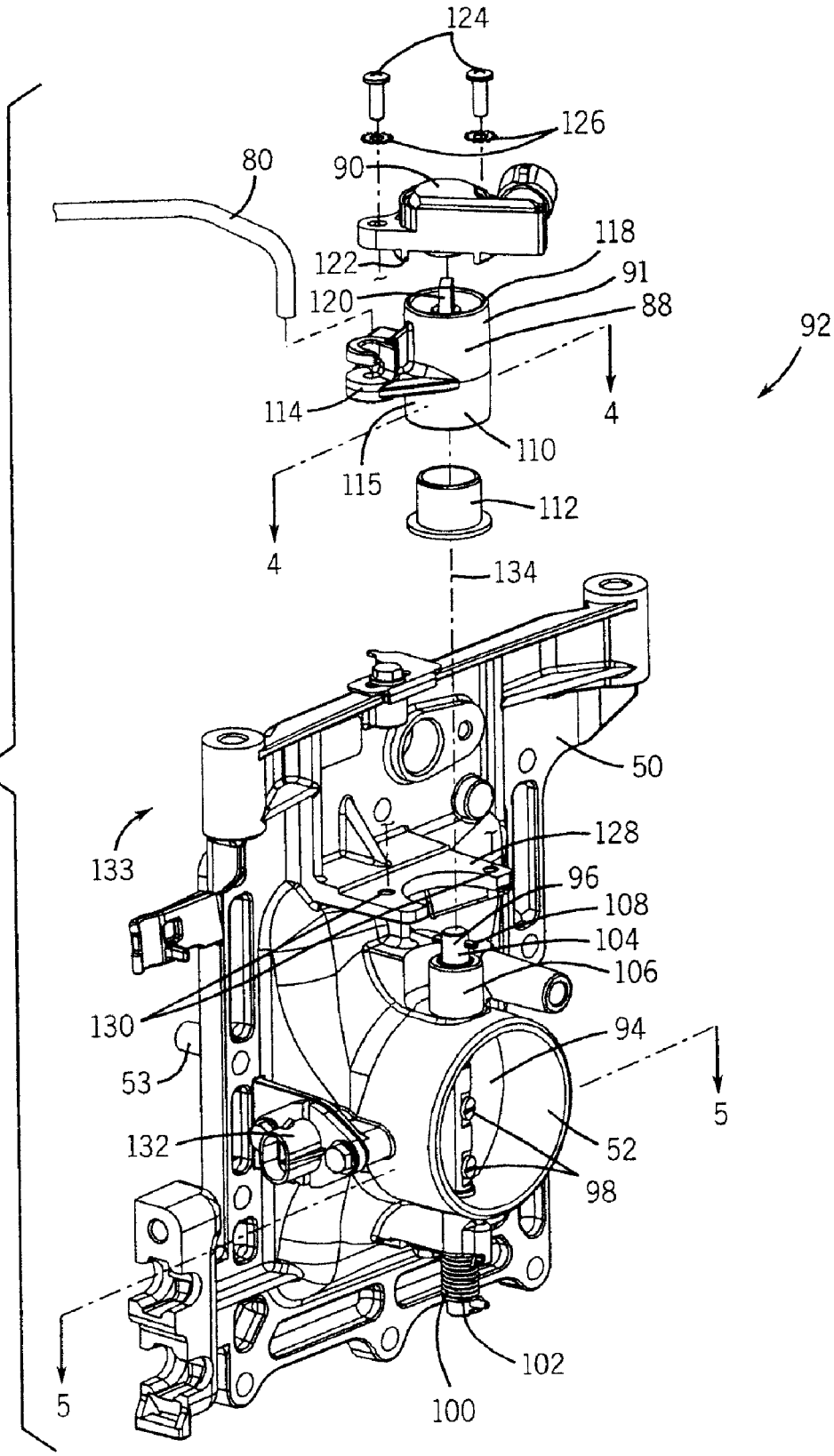
FIG. 3 is an exploded view of the throttle body and throttle assembly of FIG. 2.
Figure 5:
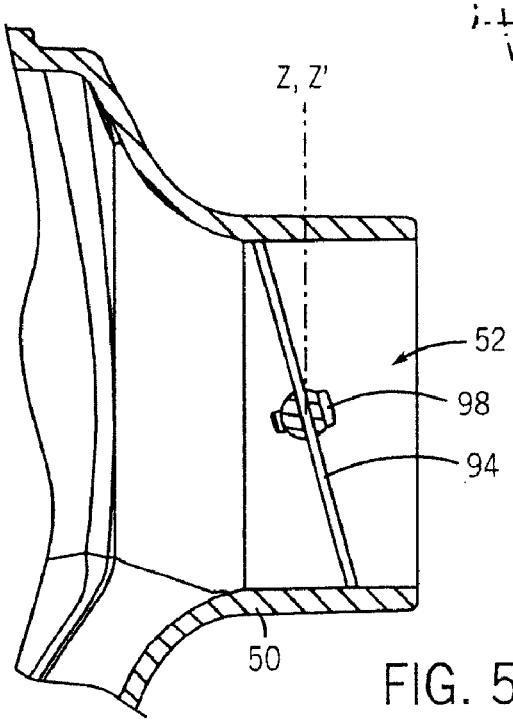
FIG. 5 is a cross-sectional view of a portion of the throttle assembly of FIG. 3 taken along line 5—5 and shows a closed throttle plate position.

FIG. 3 shows an exploded view of throttle assembly 92. Throttle body 50 is mounted to engine 12 with opening 52 in fluid communication with the combustion chambers of engine 12 and in general alignment with a front 51 of engine 12, as best viewed in FIG. 1. The front 55 of engine 12 is in linear alignment with an operator and passengers of watercraft 24. Referring back to FIG. 3, throttle plate 94 is rotatably positioned within opening 52 to regulate air flow through throttle body 50. During idle operation of engine 12, throttle plate 94 remains closed, as shown in FIGS. 3 and 5, and combustion gas is provided to engine 12 via an opening or idle air bypass 53. Opening 53 provides a path for combustion gas into engine 12 when throttle plate 94 prevents the passage of combustion gas through opening 52. Opening 53 is formed in throttle body 50 generally opposite air intake opening 52 and faces generally towards engine 12 and away from the operator and passengers of the watercraft or other recreational product.

Throttle plate 94 is secured to a throttle shaft 96 by a plurality of fasters 98 such that rotation of throttle shaft 96 results in rotation of throttle plate 94. A spring 100 is positioned about a first end 102 of throttle shaft 96 and biases throttle plate 94 to a closed position in opening 52, as shown in FIG. 3. A second end 104 of throttle shaft 96 extends through a mount structure 106 of throttle body 50. A pin 108, preferably a roll pin, extends through throttle shaft 96 and engages a second end 110 of actuator 88. A bushing 112 is constructed to fit about mount 106 and facilitates rotation of actuator 88 relative thereto.

Third throttle link 80 engages an arm 114 of actuator 88. Arm 114 is integrally formed with actuator 88 and extends from a body 115 thereof. By extending from body 115 of actuator 88, arm 114 allows for a generally linear translation of third throttle link 80 to rotate actuator 88. Body 115 has a generally cylindrical shape and extends from first end 91 of actuator 88 to second end 110. First end 91 of actuator 88 has a bearing surface 118 there-about and an extension, or tab 120, extending therefrom. Tab 120 is constructed to engage throttle position sensor 90 located within mount 89 such that movement of actuator 88 results in a change of signal from throttle position sensor 90. Throttle position sensor 90 is within a mount 89 positioned about first end 91 of actuator 88. It is understood that in those applications where a throttle position sensor is mounted remotely relative to a throttle shaft that throttle position sensor 90 can be merely a molded mount attachable to the throttle body and constructed to support an end of the actuator therebetween.

A flange 122 of TPS mount 89 engages bearing surface 118 of actuator 88 and maximizes a frictionless rotational engagement therebetween. A plurality of fasteners 124 and corresponding washers 126 secure TPS mount 89 to throttle body 50 at a boss, or mounting flange 128, extending from throttle body 50. Mounting flange 128 includes a pair of holes 130 constructed to receive fasteners 124 therein to secure TPS mount 89 to throttle body 50 with actuator 88 disposed therebetween. Actuator 88 is free to rotate relative to throttle body 50 and TPS mount 89. As such, operator manipulation of throttle actuator 55, show in FIG. 2, moves third throttle link 80 which in turn rotates actuator 88 relative to throttle body 50 and TPS mount 89.

A temperature probe 132 extends through throttle body 50 into air intake opening 52 on an engine side 133 of throttle plate 94 and is in electrical communication with ECU 14 shown in FIG. 2. Referring back to FIG. 3, temperature probe 132 is positioned in air intake opening 52 such that it does not interfere with rotation of throttle plate 94. Temperature probe 132 communicates to the ECU a temperature of combustion air provided to the engine to allow the ECU to more effectively control overall engine efficiency and, particularly, fuel combustion efficiency.

Actuator 88, TPS mount 89, bushing 112, and throttle shaft 96 all share a common axis 134. Common axis 134 is the axis of rotation of throttle shaft 96 to which throttle plate 94 is mounted. Although mounted about throttle shaft 96 and directly responsive to operator movement of throttle actuator 55, actuator 88 is partially rotatable about common axis 134 without affecting the position of throttle plate 94. That is, throttle plate 94 remains closed, as shown in FIG. 3, through a predetermined range of operator movement of throttle actuator 55, yet the RPM of the engine increases, as will be described in further detail below with respect to FIGS. 4–9.

Figure 4:
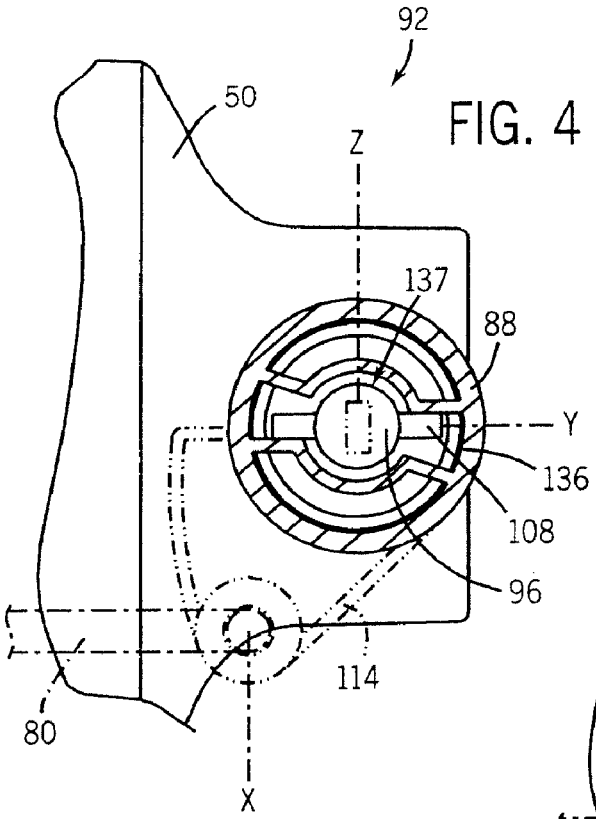
FIG. 4 is a cross-sectional view of a portion of the throttle assembly of FIG. 3 taken along line 4—4 and shows a throttle assembly idle position.

As shown in FIG. 4, when assembled, throttle shaft 96 and pin 108 of throttle assembly 92 are positioned in a recess 136 of actuator 88. Recess 136 has a bowtie shaped cross-section 137 that allows partial rotation of pin 108 and shaft 96 relative thereto. Although shown having a bowtie shaped cross-section it is understood that such a cross-section is merely by way of example and that other arrangements could be used to achieve the result of allowing actuator 88 to determinably engage and disengage from a driving relationship with throttle shaft 96, thereby providing a "deadband" in the throttle linkage. An example of such an arrangement would be a portion of the recess constructed to receive the throttle shaft and another portion of the recess constructed to receive a keying element such as one end of a pin extending from the shaft.

Figure 6:
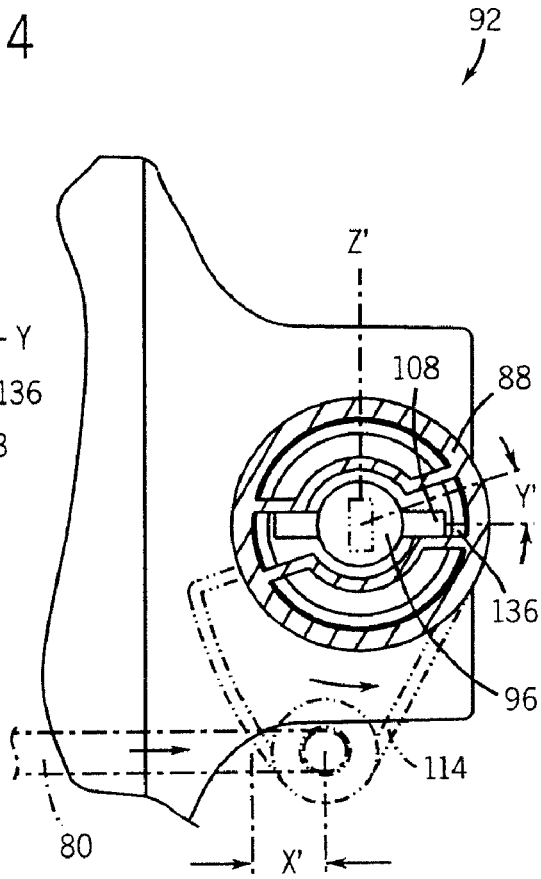
FIG. 6 is a view similar to FIG. 4 and shows the throttle assembly in a throttle assembly transition position.

The relation of actuator 88 to pin 108, as shown in FIG. 4, indicates an idle throttle position. Comparing FIG. 4 to FIG. 6, as an operator advances throttle actuator 55, third throttle link 80 is advanced a distance of X', as shown in FIG. 6. The relation of actuator 88 to pin 108, as shown in FIG. 6 indicates a transition throttle position. The transition throttle position is generally defined as the point during engine operation where the combustion process preferably transitions from a stratified combustion operation to a homogeneous combustion operation wherein stratified and homogenous define the type of combustion charge supplied to the engine, as is known in the art.

The displacement of third throttle link 80 distance X' results in rotation of actuator 88 but does not move pin 108 or throttle shaft 96. When third throttle link 80 is displaced distance X', actuator 88 rotates a distance Y'. In one embodiment, distance Y' is not more than 35 degrees and is preferably approximately 19 degrees. During operation, although an operator has advanced throttle actuator 55 and displaced third throttle link 80 a distance of X', as shown in comparing FIGS. 4 and 6, recess 136 prevents actuator 88 from displacing throttle shaft 98. As such, throttle plate 94 remains closed, as shown in FIG. 5, as actuator 88 is rotated relative thereto. Such a construction forms the deadband in the throttle assembly. One exemplary explanation of the deadband is where the throttle assembly receives an input command having a value of X'and throttle plate 94 does not experience a corresponding output. Such a construction allows throttle plate 94 to remain closed for a predetermined range of engine operation, not merely an engine idle condition.

Throttle plate 94 remains closed, as shown in FIG. 5, up to the transition of throttle position shown in FIG. 6. By maintaining throttle plate 94 closed until approximately the point the engine requires a homogenous combustion charge, a minimum amount of engine noise is allowed to exit the engine through air intake opening 52, while air bypass 53 is sized large enough to provide an adequate charge. By the time that the engine requires a generally homogenous combustion charge, and the throttle plate begins to open with further advancement of the throttle actuator, the overall operating noise of the engine reaches a level that overcomes any noise that may exit the engine through the air intake opening 50. Maintaining throttle plate 94 closed beyond engine idle speed reduces the overall amount of engine noise allowed to exit the engine through air intake opening 52.

Figure 7:
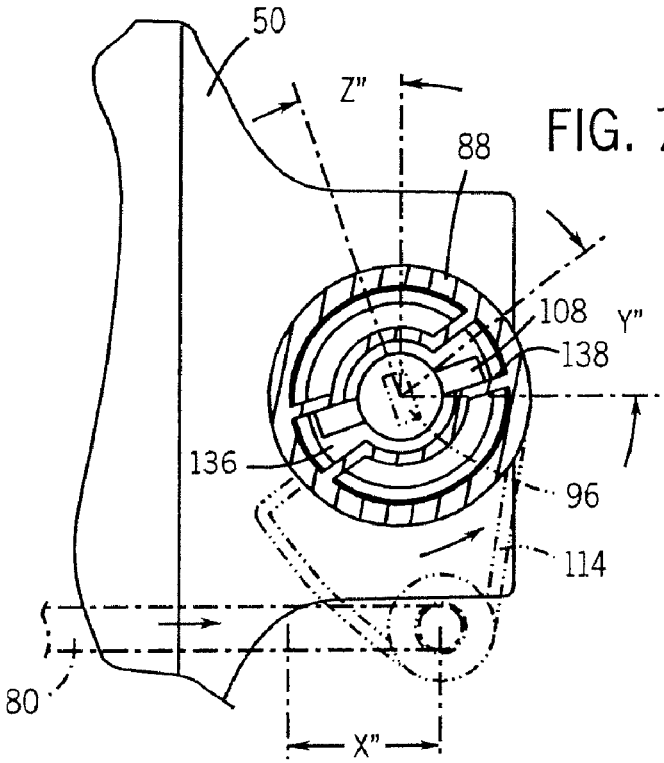
FIG. 7 is a view similar to FIGS. 4 and 5 and shows the throttle assembly rotated past the throttle assembly transition position.
Figure 8:
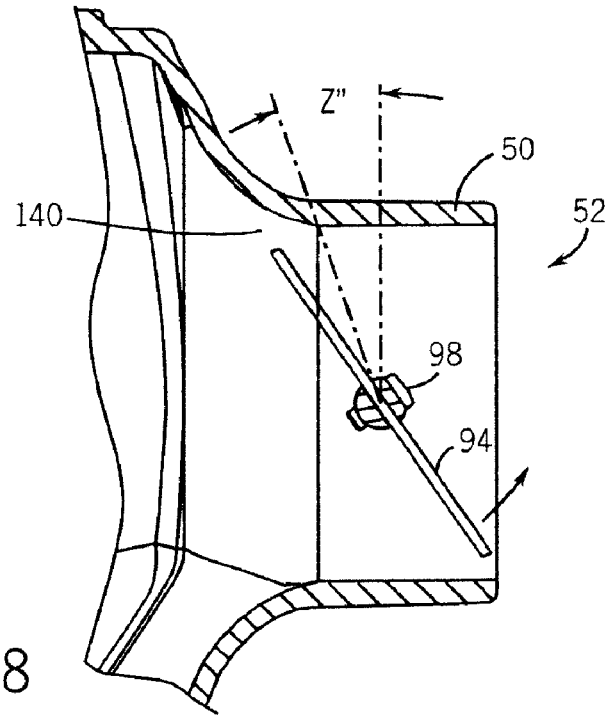
FIG. 8 is a view similar to FIG. 5 and shows the throttle assembly with the throttle plate rotated beyond the closed throttle plate position.

Comparing FIGS. 6 and 7, as an operator advances the throttle actuator beyond a distance X', shown in FIG. 6, any further increase in the position of the throttle actuator provides a corresponding rotation of throttle shaft 96 and opens throttle plate 94. As shown in FIG. 7, as third throttle link 80 is advanced a distance X", actuator 88 is rotated an angle of Y" while throttle shaft 96 rotates an angle of Z". The difference between Y" and Z" is equal to the amount of deadband engagement—distance Y', as shown in FIG. 6, between actuator 88 and throttle plate 94. Once third throttle link 80 is displaced a distance greater than X', as shown in FIG. 6, any further displacement of third throttle link 80 results in rotation of throttle shaft 96, as shown in FIG. 7. A leading edge 138 of recess 136 engages pin 108 and rotates throttle shaft 96. As leading edge 138 comes into contact with pin 108, as shown in FIGS. 7 and 8, throttle plate 94 rotates relative to opening 52 of throttle body 50. As shown in FIG. 8, when the throttle actuator is advanced beyond the transition throttle position, throttle plate 94 rotates to an open position, indicated by a gap 140 formed between throttle plate 94 and throttle body 50, allowing combustion gas to pass through opening 52.

Figure 9:
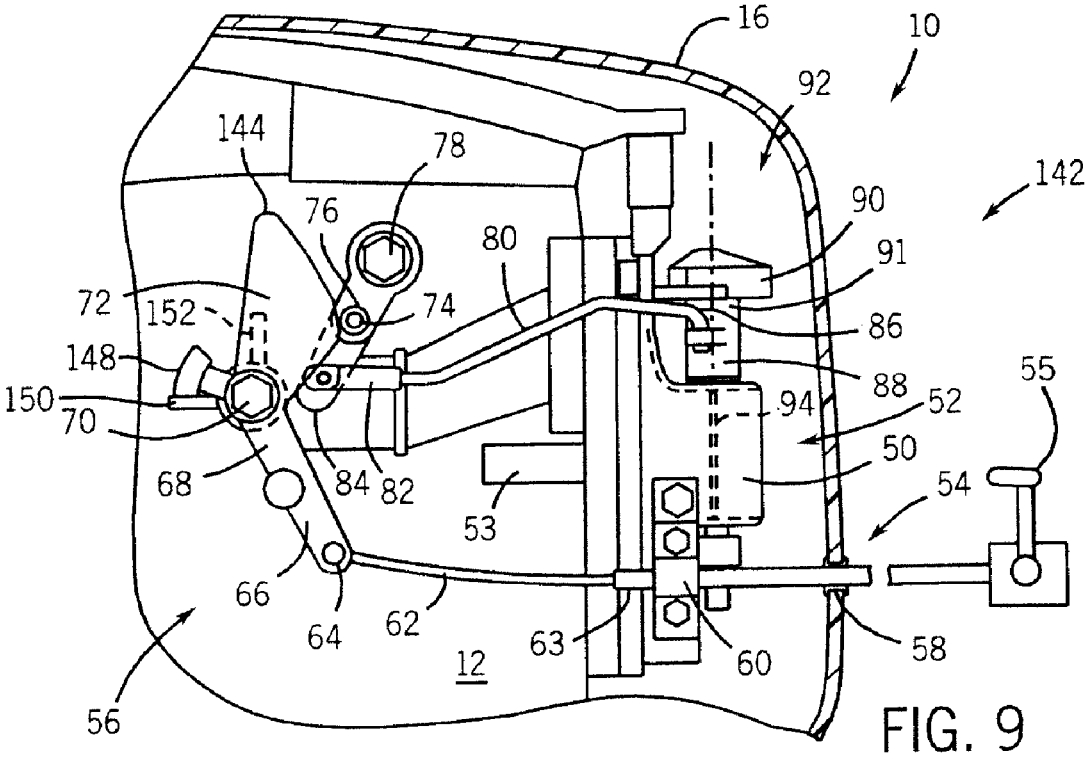
FIG. 9 is a detail of the throttle assembly of FIG. 2 with the throttle actuator, throttle linkage assembly, and throttle assembly in an idle throttle position.

During idle operation of outboard motor 10, as shown in FIG. 9, when throttle actuator 55 is in an idle throttle position 142, throttle plate 94 is disposed generally across opening 52 thereby preventing the passage of combustion gas therethrough. Opening 53 provides combustion gas to pass through throttle body 50 thereby providing idle operation combustion gas to engine 12. Second arm 72 of first throttle link 66 includes a cam, or cam face 144 constructed to engage pin 74 of second throttle link 76.

Figure 10:
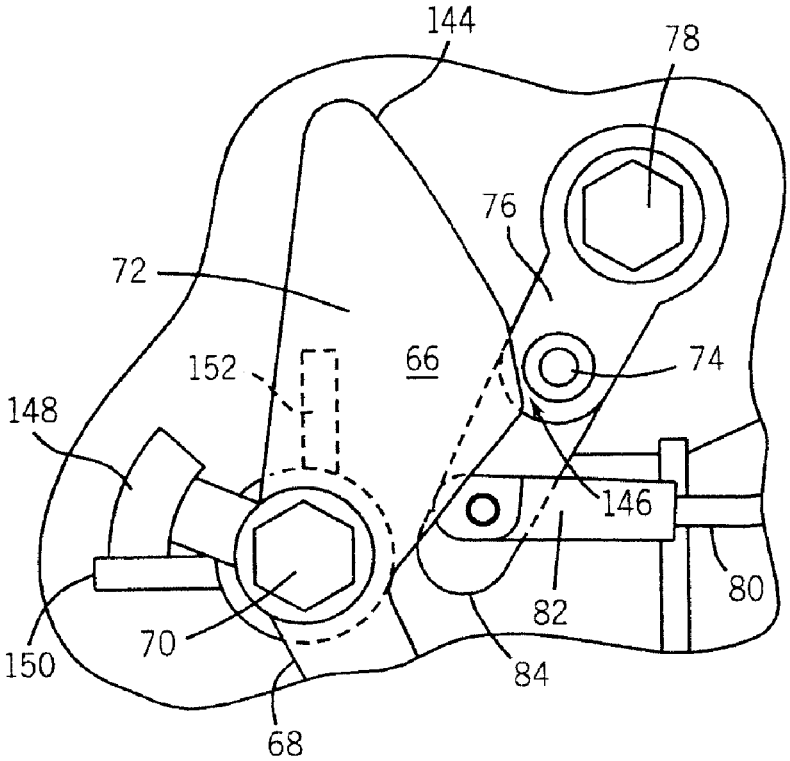
FIG. 10 is a detail of the throttle linkage assembly in the idle throttle position as shown in FIG. 9.
Figure 12:
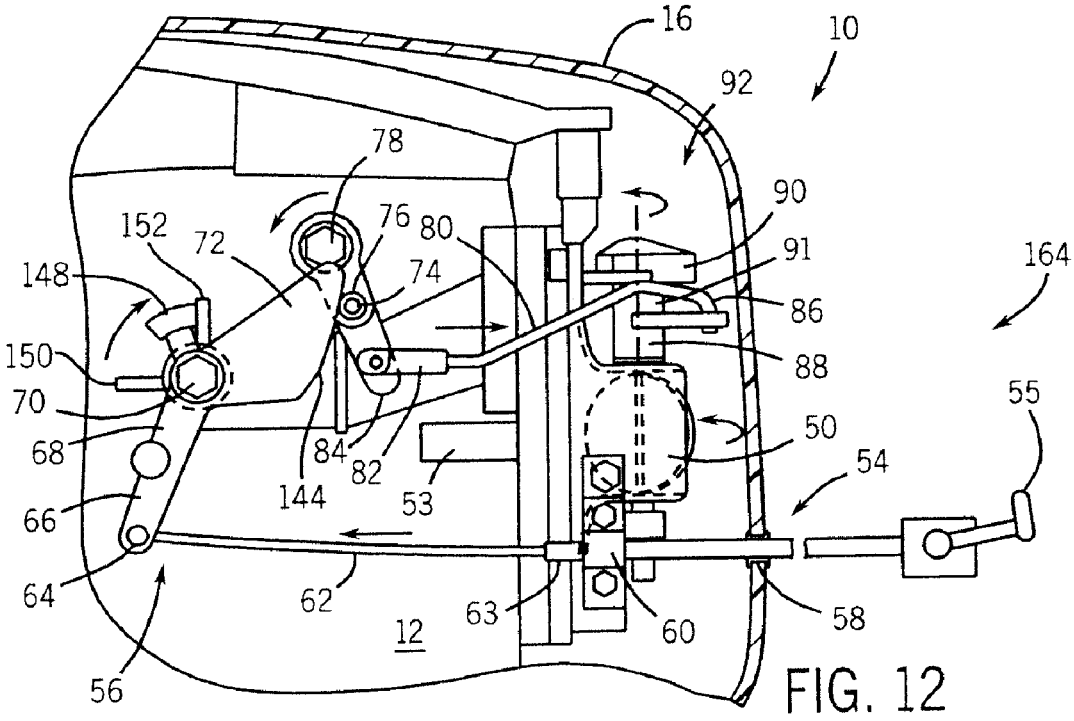
FIG. 12 is the throttle actuator, throttle linkage assembly, and throttle assembly of FIG. 9 advanced to a wide open throttle position.

As shown in FIG. 10, at idle operation of engine 12, a small gap 146 is formed between cam face 144 of first throttle link 66 and pin 78 of second throttle link 76. First throttle link 66 includes a tab, or third arm 148 integrally formed therewith. Third arm 148 is constructed to engage a first throttle stop 150 and a second throttle stop 152. Throttle stops 150, 152 are integrally formed with engine 12 and restrict the movement of throttle linkage 56 and define an idle throttle linkage position, as shown in FIGS. 9 and 10, and a wide open throttle linkage position, as shown in FIG. 12. Such a construction forms a throttle linkage assembly having no means of adjustment and wherein the range of rotation of each of the links of the throttle linkage assembly is permanently fixed.

Referring back to FIG. 9, with throttle actuator 55 in idle throttle position 142, third arm 148 of first throttle link 66 abuts first throttle stop 150 thereby permanently fixing the engine idle throttle linkage positions. Cam face 144 of second arm 72 of first throttle link 66 disengages from pin 74 with gap 146 therebetween. During idle throttle position 142, second throttle link 76, third throttle link 80, and actuator 88 are maintained in an idle position and mechanically separated from throttle actuator 55 by gap 146 between first and second throttle links 66, 76.

Figure 11:
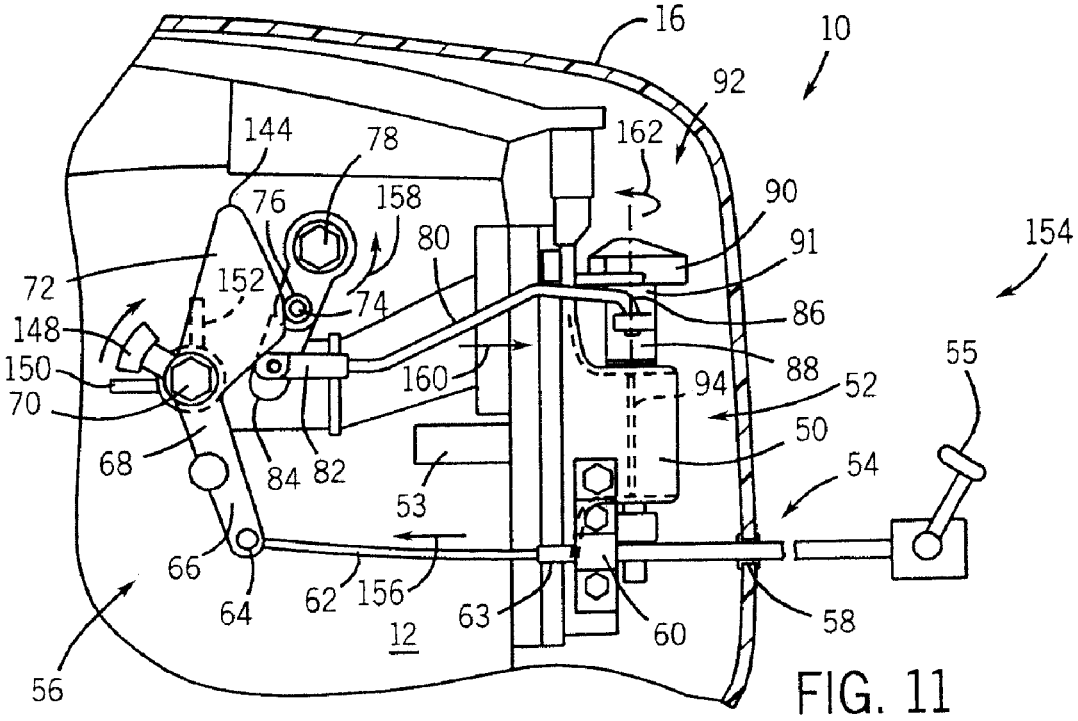
FIG. 11 is the throttle actuator, throttle linkage assembly, and throttle assembly of FIG. 9 advanced to an engine transition position.

As shown in FIG. 11, throttle actuator 55, throttle linkage assembly 56, throttle assembly 92 have been advanced to their respective engine transition positions 154. Throttle actuator 55 is shown advanced to a transition displacement, indicated by arrow 156, of throttle cable 62. Displacement 156 rotates first throttle link 66 such that third arm 148 disengages from first throttle stop 150 and rotates toward second throttle stop 152. Cam face 144 engages pin 74 of second throttle link 76 and slides there along rotating second throttle link about pin 78. Second throttle link 76 rotates in the direction of arrow 158 and displaces third throttle link 80 in the direction of arrow 160. Displacement 160 of third throttle link 80 rotates actuator 88 indicated generally by arrow 162.

Throttle position sensor 90 signals to the ECU the movement 162 of actuator 88. The ECU, in response to the signal from throttle position sensor 90, adjusts predetermined engine operating parameters. One of the engine parameters that is adjusted is the amount of fuel provided to the engine. The amount of fuel provided to the engine is increased in response to the throttle actuator adjustment. By adjust the amount of fuel provided to the engine at transition throttle position 154, the operating speed of the engine is increased. Even though the operating speed and the amount of fuel provided to the engine is increased, from idle throttle position 142, shown in FIG. 9, to transition throttle position 154 shown in FIG. 11, throttle plate 94 remains closed. This is accomplished because the air bypass 53 allows sufficient air induction into the engine via a second opening.

FIG. 12 shows a wide open throttle position 164. Throttle actuator 55 is fully advanced. Third arm 148 of first throttle link 66 is rotated into contact with second throttle stop 152. Second throttle stop 152 permanently fixes the position of throttle linkage assembly 56 and throttle assembly 92 during wide open throttle operation. Third throttle link 80 rotates actuator 88 beyond transition throttle position 154, as shown in FIG. 11, so that actuator 88 engages throttle plate 94. As shown in FIGS. 11 and 12, when the throttle actuator is advanced beyond transition throttle position 154 to wide open throttle position 164, throttle plate 94 rotates approximately 90 degrees relative to opening 52 thereby allowing combustion gas to pass therethrough. As engine 12 needs more combustion gas to mix with the fuel in order to transition from the stratified combustion stage to a homogeneous combustion stage, throttle plate 94 rotates in opening 52 to allow more combustion gas to pass therethrough. By maintaining the throttle plate closed across opening 52 during relatively low speed operation of engine 12, throttle assembly 92 reduces the amount of engine noise emitted toward an operator.

As described above, the TPS provides an output indicative of throttle plate or throttle shaft position when the throttle plate is open, but also provides an output indicative of throttle actuator position when the throttle plate is closed. More particularly, the TPS is operationally connected to the throttle shaft so as to provide a relatively precise measurement of throttle plate position when the throttle plate is open. That is, the throttle plate cannot rotate any further than that allowed by the throttle linkage. As such, the TPS cannot provide an output indicative of throttle actuator position different than that output at WOT. Simply put, the maximum rotation permitted of the throttle plate, i.e. to a WOT position, also defines the maximum translation that may be achieved by the throttle linkage. In this regard, WOT is only achieved when the throttle linkage is fully extended. Accordingly, the ECU may determine, with relative accuracy, the position of the throttle plate relative to WOT, independent of the position of the throttle actuator. The same is not true for idle.

Figure 13:
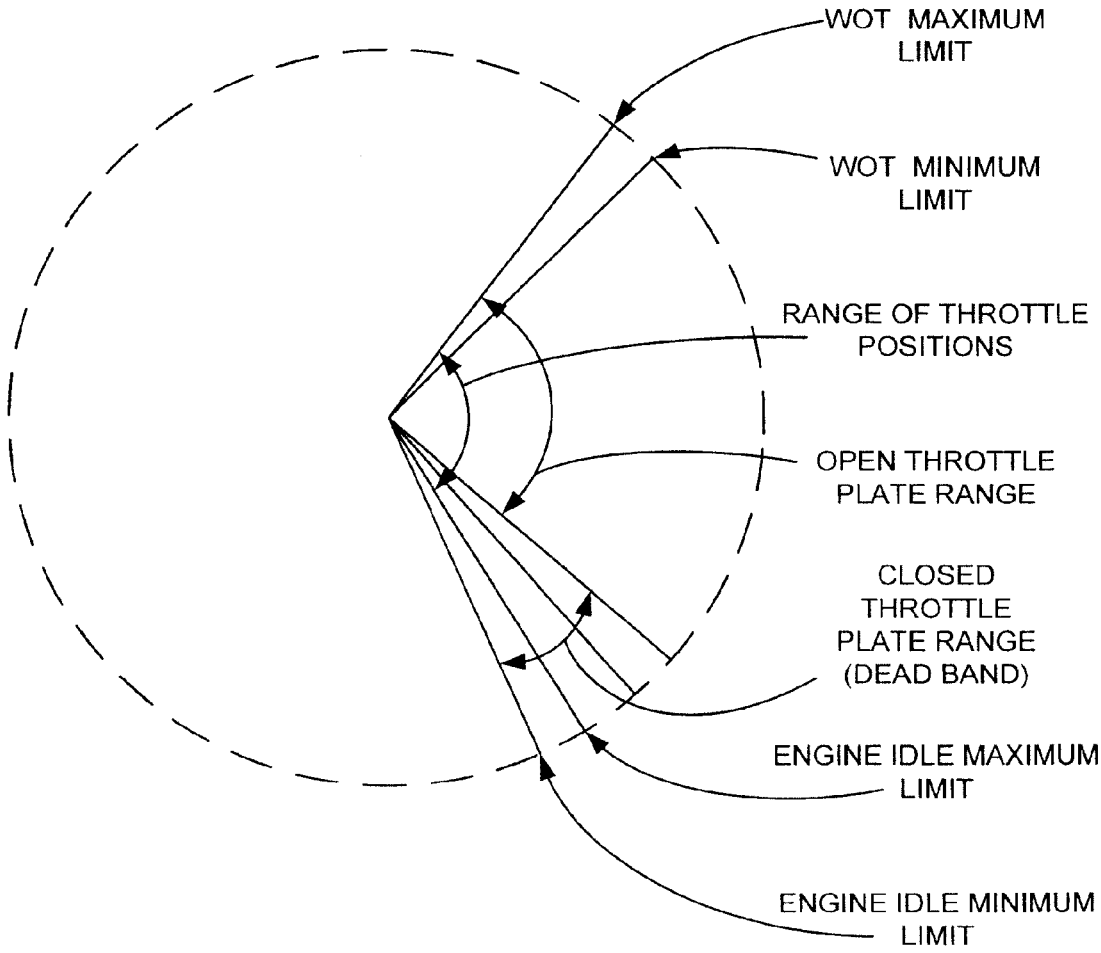
FIG. 13 is a diagram illustrating range of throttle operation in accordance with the present invention.

Referring now to FIG. 13, the TPS is constructed and designed to provide an output indicative of throttle actuator position when the throttle plate is closed. In other words, the TPS may provide an output different than that provided when the throttle plate is closed based on more-toward-idle movement or retraction of the throttle linkage. As mentioned above, idle is not defined by throttle plate closing. Holes in the throttle plate or other air bypasses may allow for the translation of air to the engine to prevent engine stall when the throttle plate is closed. As such, to provide feedback to the ECU when the throttle plate is closed, the TPS outputs throttle actuator position data. As noted above, the throttle linkage includes a range or deadband, e.g. 19 degrees of linkage translation, whereupon movement of the throttle linkage does not result in a change in position of the throttle plate. In this deadband, a pre-set range of idle throttle position values are defined. In terms of voltage readings by the TPS, an exemplary range of idle range of voltages may be defined as 196 mV to 782 mV. As will be described, when the TPS provides an input to the ECU indicating that the throttle actuator or linkage is positioned within the pre-set or pre-defined range of idle throttle position values, i.e. between engine idle maximum and engine idle minimum, and the detected throttle position is more toward idle than an idle position benchmark, the ECU will deem the throttle to be at idle and control present and subsequent engine operation accordingly. Moreover, the exact position of the throttle actuator within the pre-set range, if more idle than the current idle position benchmark, will serve as the benchmark for subsequent engine operation until another, or next, detection of the throttle actuator position within the range and more idle than the new idle position benchmark; whereupon, the ECU will again reestablish the benchmark for subsequent engine operation.

Not only does a positioning of the throttle actuator at a more idle position of the current idle position benchmark reestablish a new idle throttle position for subsequent engine operation, such positioning of the throttle actuator will cause a reestablishment of WOT for subsequent engine operation. That is, there is a fixed range of angular rotation for engine operation that is defined between idle and WOT. In this regard, with positioning and detection of throttle position below the current idle position benchmark, a new WOT position a fixed distance from the detected "idle" position is established. In a preferred embodiment, 94 degrees of rotation defines the fixed distance between idle and WOT. As such, with the establishment of a new idle position benchmark, a new WOT benchmark, 94 degrees rotationally from the idle position benchmark, is also established. As a result, while a WOT range of values may be defined 94 degrees rotationally from the engine idle minimum and maximum values, with the present invention it is not necessary to calibrate subsequent engine operation based on detection of throttle position within the WOT position range.

Figure 14:
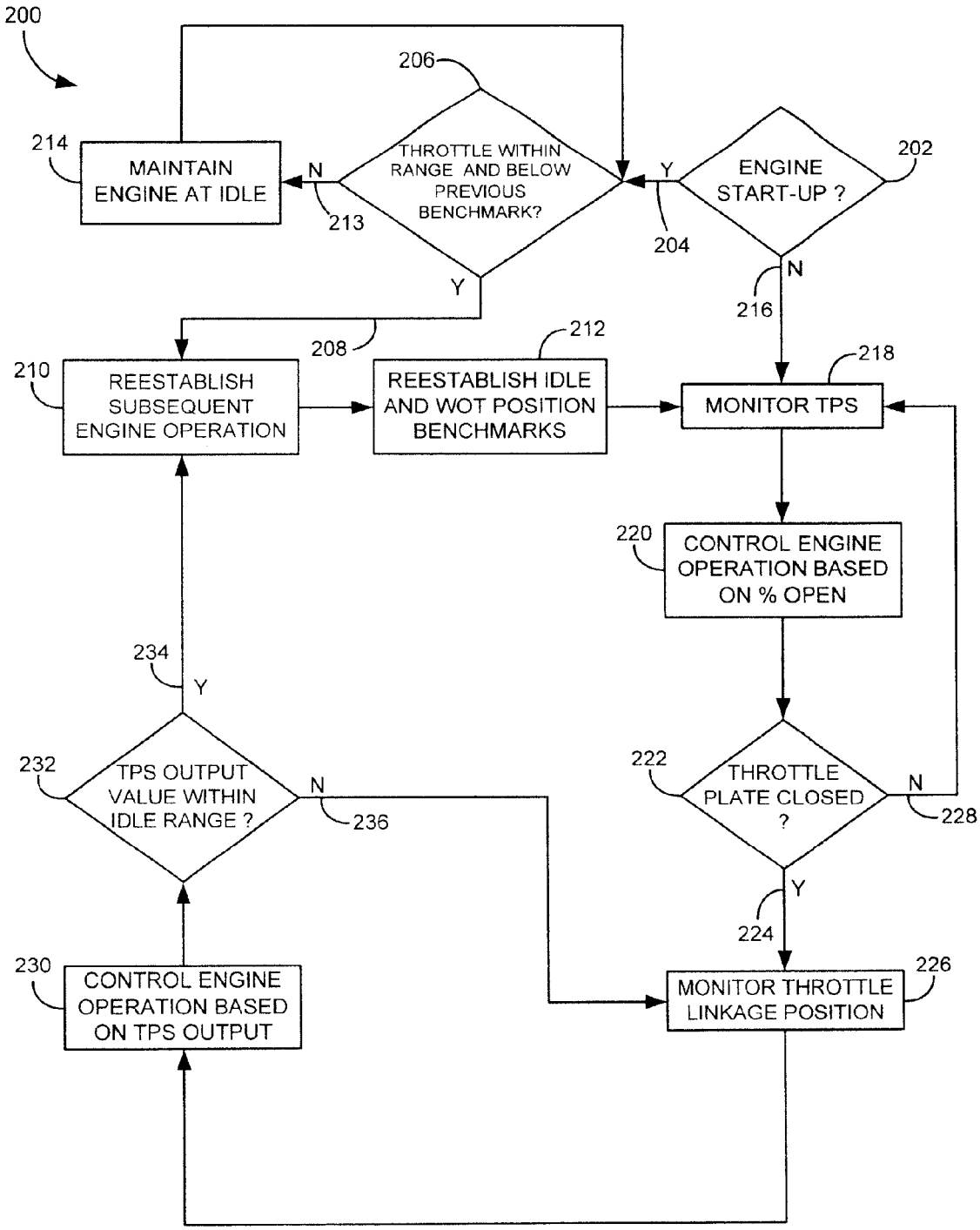
FIG. 14 is a flow chart setting forth the steps of an engine control algorithm for reestablishing present and subsequent engine operation in accordance with the present invention.

Referring now to FIG. 14, the steps of a control algorithm for calibrating an ECU for present and subsequent engine operation are set forth. The control algorithm or technique 200 begins with a determination as to whether the engine is operating in a startup mode 202. If so 202, 204, the ECU will access feedback provided by the TPS indicative of throttle plate and/or throttle actuator position. If the throttle actuator is positioned within a pre-set range that corresponds to acceptable idle throttle position values 206, 208, the ECU will reestablish present and subsequent engine operation 210 if the detected idle position is more toward idle than the current idle position benchmark. In this regard, during an engine operating cycle, an established idle position benchmark within the pre-set range will define idle throughout the engine cycle until throttle actuator positioning within the pre-set range at a position more towards idle than the current idle position benchmark. Moreover, the ECU will use the exact idle throttle position value as provided by the TPS as an idle position benchmark and a fixed angular distance from the idle position benchmark as a WOT position benchmark for subsequent engine operation 212. That is, until a new benchmark is established, the existing idle throttle position will define "idle" for subsequent engine operation.

If the throttle actuator is at a position at engine startup outside the acceptable range 206, 213, the engine will maintain and continue operation of the engine at idle independent of subsequent positioning of the throttle actuator 214. In this regard, the ECU will not allow the engine to run pursuant to the parameters of a more open throttle position until the throttle actuator is first positioned within the pre-set idle range. In another embodiment, the ECU may require engine shutdown as well as idle throttle positioning before allowing a more open throttle engine operation. As a result, the ECU recalibrates at each engine startup.

If the engine is not in startup 202, 216 or the throttle actuator has been properly positioned for recalibration of the ECU, the ECU continues to receive and analyze feedback received from the TPS 218 with respect to throttle plate opening and throttle actuator position. Accordingly, the ECU will control the fuel injection, oil injection, and ignition systems to optimize engine performance based on throttle plate opening 220. If the throttle plate is closed 222, 224, the actual position of the throttle actuator, as determined through the throttle linkage, is monitored 226. If the throttle plate is open 222, 228, the degree or percent open is accurately determined based on a comparison of actual throttle plate position relative to a known WOT position. Since WOT defines the maximum rotation of the throttle plate and the maximum extension of the throttle linkage, the ECU is able to determine, with precision, the actual position of the throttle plate and can control engine operation accordingly. As such, the engine is not caused to operate in accordance with WOT parameters until the TPS provides output indicating that the throttle plate has reached its maximum rotation, i.e. 94 degrees of translation/rotation from the idle position benchmark.

If the throttle plate is closed 222, 224, the ECU will analyze the output of the TPS to determine throttle linkage or throttle actuator position 226. The ECU will then control operation of the engine based on the actual position of the throttle actuator or linkage rather than the throttle plate (which is deemed closed) 230. As referenced above, there is a degree of engine operation between operation at throttle plate closing and at engine idle. As such, the ECU is able to optimize engine performance in this range based on the actual position of the throttle actuator as measured by the TPS.

When the throttle plate is closed, the ECU analyzes the output of the TPS to determine if the throttle actuator or linkage has been positioned within a pre-set range 232. If the throttle actuator is detected within the pre-set range 232, 234, the ECU will then determine if the detected position is more idle than the idle position benchmark and, if so, the ECU consider the throttle actuator to be at an idle throttle position. In essence, detection of the throttle actuator in this pre-set range and below the current idle position benchmark is indicative of a go-to-engine-idle command from the throttle actuator to the ECU. Accordingly, the ECU will reestablish present and subsequent engine operation 210. Moreover, the ECU will reset the idle position benchmark described above to the value detected at 232 and the WOT position benchmark based on a fixed distance from the value detected at 232. In this regard, the idle position benchmark and WOT position benchmark for engine operation is reset each instance the throttle actuator is positioned within the pre-set range at a position below the idle position benchmark. One skilled in the art will appreciate that the ECU could be controlled to reset the idle and WOT position benchmarks at other intervals, e.g. every-other detection of the throttle actuator within the pre-set range would be just one of many possibilities contemplated. Alternately, the ECU could be controlled to reset the idle and WOT position benchmarks only when the difference between the last detected idle throttle position and the idle position benchmark exceeds a threshold. Additionally, in a preferred embodiment, the ECU only stores one idle position benchmark and rather than maintain a history of past benchmarks so as to reduce computational requirements of the microprocessor as well as memory requirements. As such, a new benchmark may be established independent of previous benchmarks. If the TPS output is not within idle range 232, 236, the control technique continues with monitoring of throttle actuator or linkage position 226. The control algorithm is preferably carried out continuously throughout engine operation.

Therefore, in accordance with one embodiment of the present invention, a throttle calibration control is provided and configured to determine if throttle actuator position is within an idle position range and, if so, maintain the throttle actuator position as an idle position benchmark for subsequent engine operation until a subsequent throttle actuator positioning below the idle position benchmark. The control is further configured to establish a WOT position benchmark for subsequent engine operation based on a fixed angular position from the idle position benchmark.

In accordance with another embodiment, the present invention includes a control system for an internal combustion engine. The system includes a TPS configured to provide an output indicative of actual throttle position and an ECU to control operation of an internal combustion engine. The ECU is configured to set a new engine operation paradigm for subsequent engine operation with each placement of a variable position throttle below a previous idle position benchmark.

According to another embodiment of the present invention, an outboard motor includes an internal combustion engine configured to propel a watercraft and a throttle linkage connectable to a throttle and configured to control movement of a throttle shaft and throttle plate based on input received from the throttle. The motor also includes a TPS connected to sense rotational position of the throttle shaft and translation of the throttle linkage, and is also configured to provide a first output indicative of throttle plate position relative to WOT during an open throttle plate condition and provide a second output indicative of throttle position during a closed throttle plate operation. The motor further includes an ECU configured to receive an input indicative of throttle position during closed throttle plate operation and re-establish subsequent engine operation with positioning of the throttle in a predefined idle throttle position range.

In accordance with yet a further embodiment, the present invention includes a method of throttle control calibration that includes the step determining if throttle actuator position is within an idle position range. The method also includes maintaining the throttle actuator position as an idle position benchmark for subsequent engine operation until a subsequent throttle actuator positioning in the idle position range and more toward idle than a previous idle position benchmark. A WOT position benchmark for subsequent engine operation is also established based on a fixed angular position from the idle position benchmark.

The present invention has been described in terms of the preferred embodiment, and it is recognized that equivalents, alternatives, and modifications, aside from those expressly stated, are possible and within the scope of the appending claims. While the present invention is shown as being incorporated into an outboard motor, the present invention is equally applicable with other recreational products, some of which include inboard motors, snowmobiles, personal watercrafts, all-terrain vehicles (ATVs), motorcycles, mopeds, power scooters, and the like. Therefore, it is understood that within the context of this application, the term "recreational product" is intended to define products incorporating an internal combustion engine that are not considered a part of the automotive industry. Within the context of this invention, the automotive industry is not believed to be particularly relevant in that the needs and wants of the consumer are radically different between the recreational products industry and the automotive industry. As is readily apparent, the recreational products industry is one in which size, packaging, and weight are all at the forefront of the design process, and while these factors may be somewhat important in the automotive industry, it is quite clear that these criteria take a back seat to many other factors, as evidenced by the proliferation of larger vehicles such as sports utility vehicles (SUV).

What is claimed is:

1. A throttle calibration control configured to:

determine if throttle actuator position is within an idle position range;

if so, maintain the throttle actuator position as an idle position benchmark for subsequent engine operation until a subsequent throttle actuator positioning more idle than the idle position benchmark; and establish a WOT position benchmark for subsequent engine operation based on a fixed angular position from the idle position benchmark.

2. The control of claim 1 further configured to re-set engine control with each detected throttle actuator positioning more idle than the idle position benchmark.

3. The control of claim 1 wherein the idle position range is defined by a set of throttle position actuator values within a deadband range of a throttle linkage connecting the throttle actuator to a throttle plate.

4. The control of claim 3 wherein the fixed angular position is 94 degrees.

5. The control of claim 4 further configured to determine actual throttle plate position during open throttle engine operation from feedback provided by a TPS connected to a throttle shaft designed to rotate the throttle plate between an open and closed position.

6. The control of claim 1 further configured to:

determine throttle actuator position at engine startup; and if the throttle actuator position is outside the idle position range, maintain engine idling independent of subsequent throttle actuator position until throttle position is detected in the idle position range.

7. The control of claim 6 further comprised to require engine shutdown prior to allowance of a more open throttle position.

8. The control of claim 1 further configured to re-set engine control with each detected throttle actuator position below the idle position benchmark independent of a previous detection of throttle actuator position within the idle position range.

9. The control of claim 1 further configured to re-establish the WOT position with each actuator positioning below the idle position benchmark.

10. The control of claim 1 further configured to measure a voltage drop induced by movement of a throttle actuator and measured by a TPS, and determine throttle actuator position based on a comparison of the voltage drop relative to a voltage at WOT.

11. The control of claim 1 further configured to adjust at least one of fuel flow, ignition timing, and oil injection for subsequent engine operation based on at least the idle position benchmark.

12. A method of throttle control calibration comprising the steps of:

determining if throttle actuator position is within an idle position range;

if so, maintaining the throttle actuator position as an idle position benchmark for subsequent engine operation until a subsequent throttle actuator positioning is in the idle position range and more toward idle than a previous idle position benchmark; and establishing a WOT position benchmark for subsequent engine operation based on a fixed angular position from the idle position benchmark.

13. The method of claim 12 further comprising the step of re-setting engine control with each detected throttle actuator positioning more idle than a previous idle position benchmark.

14. The method of claim 12, wherein the idle position range is defined by an actual set of throttle position actuator values within a deadband range of a throttle linkage connecting the throttle actuator to a throttle plate.

15. The method of claim 14 wherein the fixed angular position is 94 degrees.

16. The method of claim 15 further comprising the step of determining actual throttle plate position during open throttle engine operation from feedback provided by a TPS connected to a throttle shaft designed to rotate the throttle plate between an open and closed position.

17. The method of claim 12 further comprising the steps of:

determining throttle actuator position at engine startup; and if the throttle actuator position is outside the idle position range, maintaining engine idling independent of subsequent throttle actuator position until throttle position is detected in the idle position range.

18. The method of claim 17 further comprising the step of requiring engine shutdown prior to allowance of a more open throttle position.

19. The method of claim 12 further comprising the step of re-setting engine control with each detected throttle actuator position within the idle position range independent of a previous detection of throttle actuator position within the idle position range.

20. The method of claim 12 further comprising the step of re-establishing the WOT position with each actuator positioning in the idle position range.

21. The method of claim 12 further comprising the step of measuring a voltage drop induced by movement of a throttle actuator and measured by a TPS, and determining throttle actuator position based on a comparison of the voltage drop relative to a voltage at WOT.

22. The method of claim 12 further comprising the step of adjusting at least one of fuel flow, ignition timing, and oil injection for subsequent engine operation based on at least the idle position benchmark.

23. A method of throttle control calibration comprising the steps of:

determining if a throttle actuator position is within an idle position range;

if the throttle actuator position is within an idle position range then comparing the throttle actuator position to an idle position benchmark;

if the throttle actuator position is lower than the idle position benchmark, then establishing the throttle actuator position as the idle position benchmark; and establishing a WOT position benchmark for subsequent engine operation based on a fixed angular position from the idle position benchmark.

24. The method of claim 23 further comprising the step of re-setting engine control with each time the throttle actuator position is lower than the idle position benchmark.

25. The method of claim 23 wherein the idle position range is defined by an actual set of throttle position actuator values within a deadband range of a throttle linkage connecting the throttle actuator to a throttle plate.

26. The method of claim 23 further comprising the step of adjusting at least one of fuel flow, ignition timing, and oil injection for subsequent engine operation based on at least the idle position benchmark.

* * * * *